US005714441A

United States Patent [19]

Berlowitz

[11] Patent Number: 5,714,441

[45] Date of Patent: Feb. 3, 1998

[54] ADDITIVE COMBINATION TO REDUCE DEPOSIT FORMING TENDENCIES AND IMPROVE ANTIOXIDANCY OF AVIATION TURBINE OILS

[75] Inventor: Paul Joseph Berlowitz, East Windsor, N.J.

[73] Assignee: Exxon Research and Engineering Company, Florham Park, N.J.

[21] Appl. No.: 678,839

[22] Filed: Jul. 12, 1996

[51] Int. Cl.[6] ..... C10M 141/06; C10M 141/08; C10M 157/04; C10M 157/06

[52] U.S. Cl. ..... 508/258; 508/465; 508/478; 508/479; 508/509

[58] Field of Search ..... 508/257, 258, 508/256, 509, 478, 465, 479

[56] References Cited

U.S. PATENT DOCUMENTS

| | | | |
|---|---|---|---|
| 2,398,202 | 4/1946 | Zublin et al. | 508/509 |
| 2,644,793 | 7/1953 | Rudel et al. | 508/465 |
| 3,137,722 | 6/1964 | Toland, Jr. | 508/509 |
| 3,149,075 | 9/1964 | Hedenburg et al. | 508/257 |
| 3,198,797 | 8/1965 | Dexter et al. . | |
| 3,202,681 | 8/1965 | Dexter et al. . | |
| 3,245,992 | 4/1966 | Dexter et al. | 508/257 |
| 3,250,708 | 5/1966 | Dazzi et al. . | |
| 3,278,436 | 10/1966 | Dazzi et al. | 508/256 |
| 3,296,135 | 1/1967 | Cuppen et al. | 508/256 |
| 3,322,763 | 5/1967 | Dazzi et al. . | |
| 3,492,233 | 1/1970 | Heppiewhite et al. | 252/51.5 |
| 3,509,214 | 4/1970 | Braid et al. | 260/576 |
| 3,573,206 | 3/1971 | Braid et al. | 252/51.5 |
| 3,642,630 | 2/1972 | MacPhail . | |
| 3,700,666 | 10/1972 | Robin et al. | 508/256 |
| 3,755,176 | 8/1973 | Kinney et al. | 508/509 |
| 3,759,996 | 9/1973 | Braid | 260/576 |
| 3,773,665 | 11/1973 | Braid | 252/50 |
| 3,849,319 | 11/1974 | Nebzydoski | 252/33.6 |
| 3,951,973 | 4/1976 | Nebzydoski | 260/248 |
| 4,130,494 | 12/1978 | Shaub et al. | 252/32.5 |
| 4,157,971 | 6/1979 | Yaffe et al. | 252/46.7 |
| 4,171,272 | 10/1979 | Wright | 508/478 |
| 4,174,284 | 11/1979 | Borel et al. | 252/48.6 |
| 4,189,388 | 2/1980 | Yaffe et al. | 252/46.7 |
| 4,559,153 | 12/1985 | Baldwin et al. | 508/509 |
| 4,820,430 | 4/1989 | Farng et al. | 252/48.6 |
| 4,931,196 | 6/1990 | Payne et al. | 252/47.5 |
| 4,997,585 | 3/1991 | Frankenfeld et al. | 252/50 |

FOREIGN PATENT DOCUMENTS

| | | | |
|---|---|---|---|
| 0002269 | 6/1979 | European Pat. Off. . | |
| 0227948 | 7/1987 | European Pat. Off. | C08K 5/00 |
| 0434464 | 6/1991 | European Pat. Off. | C10M 141/08 |
| 63-210194 | 2/1987 | Japan | C10M 105/72 |
| 63-265997 | 4/1987 | Japan | C10M 173/02 |
| 1287647 | 9/1972 | United Kingdom | C10M 3/40 |

*Primary Examiner*—Margaret Medley
*Attorney, Agent, or Firm*—Joseph J. Allocca

[57] ABSTRACT

An aviation turbine oil of reduced deposit forming tendencies and improved anti-oxidency is disclosed which comprises a major portion of a suitable aviation turbine oil base stock and a minor amount of a non-sulfur containing triazine derivation and a sulfur containing carboxylic acid.

15 Claims, No Drawings

ADDITIVE COMBINATION TO REDUCE DEPOSIT FORMING TENDENCIES AND IMPROVE ANTIOXIDANCY OF AVIATION TURBINE OILS

BACKGROUND OF THE INVENTION

1. Field of the Invention

This invention relates to ester-based, in particular diester and polyol ester-based turbo oils which exhibit superior antioxidancy and reduced deposit forming tendencies. More particularly it is related to turbo oils comprising esters of pentaerythritol with fatty acids as basestock, and containing a combination of additives which impart improved antioxidancy and reduced deposit formation.

2. Description of the Related Art

Organic compositions such as mineral oils and lubricating compositions are subject to deterioration by oxidation and in particular are subject to such deterioration at high temperatures in the presence of air. This deterioration often leads to buildup of insoluble deposits which can foul engine parts, deteriorate performance, and increase maintenance. This is particularly the case for lubricating oils used in jet aircraft where wide temperature ranges and extreme operating conditions are likely to be encountered. Proper lubrication of aircraft gas turbines, for example, requires the ability to function at bulk oil temperatures as low as −65° F. to as high as 450°–500° F.

Most lubricants contain additives to inhibit their oxidation. For example, U.S. Pat. No. 3,773,665 discloses a lubricant composition containing an antioxidant additive mixture of dioctyl diphenylamine and a substituted naphthylamine. U.S. Pat. Nos. 3,759,996; 3,573,206; 3,492,233, and 3,509,214 disclose various methods of oxidatively coupling alkylated diphenylamines with substituted naphthylamines.

Patents disclosing the use of tri-substituted triazines in lubricants generally demonstrate the antioxidant function of these molecules when either used alone, or in combination with other antioxidants. They do not describe the use of these materials as anti-deposition additives. U.S. Pat. No. 3,250,708 describes the use of several triazine derivatives, and combinations with hydroxyl aromatic co-antioxidants. U.S. Pat. Nos. 3,278,436 and 3,322,763 describes tri-substituted triazines including piperidinyl bridged triazines in combination with hydroxyl aromatics.

European Patent application 002,269 discloses the use of tri-substituted triazines where at least one of the amino substituents contains at least one hydrogen as antioxidants, and in combination with arylamine antioxidants.

U.S. Pat. No. 3,642,630 discloses the use of symmetrical and asymmetrical substituted triazines with N-substituted phenothiazine imparts good oxidation stability to synthetic ester based lubricants over a wide range of temperatures.

Other triazine derivatives disclosed in a number of patents to stabilize oils would not be suitable for use in aviation turbine oils as these derivatives contain halogens which are corrosive to metals. For example, U.S. Pat. No. 3,198,797 utilizes 2,4-dichloro-6-dialkyl-dyhydroxy-anilino-1,3,5 triazines. Similarly, U.S. Pat. No. 3,202,681 utilizes monohalogen substituted triazines, especially monochloro substituted ones.

U.S. Pat. No. 4,820,430-A discloses the lubricant composition containing a copper salt of a propionic acid derivative or an additive prepared by reacting a suitable thiodipropionic acid derivative with a suitable alcohol or amine-containing compound to impart multifunctional and antioxidant characteristics.

JP 63,265,997-A is directed to odorless aqueous lubricants useful as hydraulic fluid. The lubricant composition comprises a thiodicarboxylic acid, and preferably amine(s) or/and hydroxide(s) of alkali(ne earth) metals.

JP 63,210,194-A discloses thermally and oxidatively stable lube useful as compressor oil, turbo-charger oil, etc. that contains thiodipropionate ester obtained from thiodipropionic acid and tertiary alcohol.

EP 227,948-A discloses a polyolefin stabilizing composition containing a tris-alkyl-phenyl phosphite (I) and a dialkyl-thio-dipropionate (II). II synergistically enhances the stabilizing effectiveness of I to improve the melt-processing and color stability of the polyolefin.

EP 434,464 is directed to lube composition or additive concentrate comprising metal-free antiwear and load-carrying additives containing sulfur and/or phosphorous, and an amino-succinate ester corrosion inhibitor. The antiwear and load additives include mono- or di-hydrocarbyl phosphate or phosphite with the alkyl radical containing up to $C_{12}$, or an amine salt of such a compound, or a mixture of these; or mono- or dihydrocarbyl thiophosphate where the hydrocarbon (HC) radical is aryl, alkylaryl, arylalkyl or alkyl, or an amine salt thereof; or trihydrocarbyl dithiophosphate in which each HC radical is aromatic, alkylaromatic, or aliphatic; or amine salt of phosphorothioic acid; optionally with a dialkyl polysulfide and/or a sulfurized fatty acid ester.

It has been discovered that the deposit forming tendencies and antioxidant properties of the basic antioxidant systems, e.g., tri-substituted triazines with arylamines, can be greatly enhanced by the addition of a small amount of a sulfur containing additive, specifically sulfur containing carboxylic acids such as thiosalicylic acid (TSA) or thioethers such as Thiodipropionic acid (TDPA).

SUMMARY OF THE INVENTION

The present invention resides in a turbo oil composition exhibition enhanced antioxidancy and resistance to deposit formation, and to a method for achieving that result in turbo oils.

The gas turbine lubricating oil of the present invention comprises a major proportion of synthetic polyol ester based base stock including diesters and polyol esters, preferably polyol ester based base stock and a minor proportion of an antioxidant/deposit control additive comprising a non-sulfur containing, triazine derivative antioxidant and a sulfur containing carboxylic acid (SCCA). Other, conventional additives such as extreme pressure, pour point reduction, oxidative stability, anti-foaming, hydrolytic stability, improved viscosity index performance, anti-wear, and corrosion inhibitor additives and others may also be employed.

Improved oxidation and deposit control performance in turbo lube oils is achieved by adding to the synthetic polyol ester based lubricating oil an additive package containing a mixture of a non-sulfur containing triazine antioxidant and a SCCA.

The non-sulfur containing triazine antioxidant is used in an amount in the range 0.1 to 1.2 percent by weight, preferably 0.2 to 0.9 percent, most preferably 0.4 to 0.7 percent, while the SCCA derivative is used in an amount in the range 100 to 2000 ppm, preferably 200 to 1000 ppm, most preferably 400 to 1000 ppm.

The non-sulfur containing triazine antioxidant and a sulfur containing carboxylic acid or mixture of such sulfur containing carboxylic acids are used in a ratio in the range of 2:1 to 50:1, preferably 3:1 to 20:1, most preferably 4:1 to 15:1.

The use of a non-sulfur containing triazine antioxidant and SCCA mixture produces a turbo oil exhibiting markedly superior oxidation and deposit control properties performance as compared to the performance exhibited without the combination.

DETAILED DESCRIPTION

A turbo oil having unexpectedly superior deposition performance comprises a major portion of a synthetic polyol ester base oil and minor portion of an anti-deposition additive package consisting of a mixture of a non-sulfur containing substituted triazine derivative with a SCCA, a derivative of SCCA or mixtures thereof. Synthetic esters include diesters and polyol esters.

The diesters that can be used for the improved deposition turbo oil of the present invention are formed by esterification of linear or branched $C_6$–$C_{15}$ aliphatic alcohols with one of such dibasic acids as adipic, sebacic, or azelaic acids. Examples of diesters are di-2-ethylhexyl sebacate and dioctyl adipate.

The synthetic polyol ester base oil is formed by the esterification of an aliphatic polyol with carboxylic acid. The aliphatic polyol contains from 4 to 15 carbon atoms and has from 2 to 8 esterfiable hydroxyl groups. Examples of polyol are trimethylolpropane, pentaerythritol, dipentaerythritol, neopentyl glycol, tripentaerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula

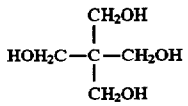

I and about 12% of dipentaerythritol having the formula

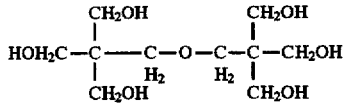

II

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the polyol ester base stock is added a minor portion of an additive mixture comprising a non-sulfur containing triazine derivative and sulfur containing carboxylic acid.

The non-sulfur containing triazine derivatives are preferably those of the form:

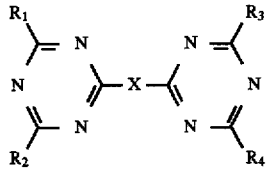

III

Or alternatively, compound III may also be of the form:

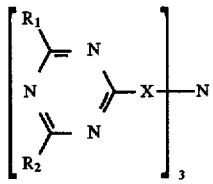

IIIa where $R_1$, $R_2$, $R_3$, $R_4$ are the same or different and are

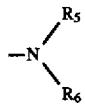

wherein $R_5$ and $R_6$ are the same or different and are selected from the group consisting of $C_2$ to $C_{16}$ branched or straight chain alkyl, aryl-$R_7$ where $R_7$ is branched or straight chain $C_2$ to $C_{16}$ alkyl, cyclohexyl-$R_7$ where $R_7$ is H or branched or straight chain $C_2$ to $C_{16}$ alkyl, and mixtures thereof. Preferably $R_1$, $R_2$, $R_3$, and $R_4$ the same or different and are all dialkyl amino groups where the alkyl chains are $C_4$ to $C_{12}$ and mixtures thereof.

For compound III, X is a bridging group which is selected from the group consisting of piperidino, hydroquinone, NH—$R_8$—NH and mixtures thereof where $R_8$ is $C_1$ to $C_{12}$ branched or straight chain alkyl and mixtures thereof.

For compound IIIa, X is selected from the group consisting of piperidino, hydroquinone, NH—$R_8$ and mixtures thereof where $R_8$ is $C_1$ to $C_{12}$ branched or straight chain alkyl and mixtures thereof.

The triazine derivative may also be of the form:

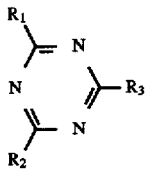

IV where $R_1$, $R_2$, and $R_3$ are identical to the description above. The preferred non-sulfur containing triazines are those of the formula III and IIIa. Those of formula IV are less preferred due to their lower molecular weight which leads to higher volatility and poorer suitability for high-temperature synthetic oil use.

The non-sulfur containing triazine antioxidant is used in an amount in the range 0.1 to 1.2 percent by weight (based on polyol ester base stock), preferably 0.2 to 0.9 percent, most preferably 0.4 to 0.7 percent.

As previously stated, to the synthetic oil base stock is added a minor portion of an additive comprising a mixture of a triazine deriviate and a sulfur containing carboxylic acid.

Sulfur containing carboxylic acids and their derivatives are described by the structural formula:

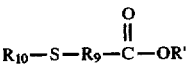

V where $R_9$ is $C_1$–$C_{12}$ alkyl, aryl, $C_1$ to $C_8$ alkyl substituted aryl, and mixtures thereof, R' is hydrogen, $R_{10}$ is hydrogen, $C_1$–$C_{12}$ alkyl, aryl, $C_1$ to $C_8$ alkyl substituted aryl, the group

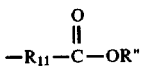

VI and mixtures thereof and wherein when $R_{10}$ is

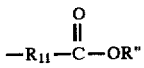

VI $R_9$ and $R_{11}$ are the same or different $C_1$–$C_{12}$ alkyl, aryl, $C_1$–$C_8$ alkyl substituted aryl and mixtures thereof and R' and R" are the same or different and are hydrogen, $C_1$–$C_8$ alkyl provided that at least one of R' and R" is hydrogen.

Representative of sulfur containing carboxylic acids corresponding to the above description are mercapto carboxylic acids of the formula:

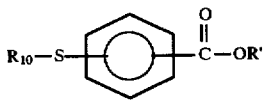

VII and its various isomers where $R_{10}$ and R' are as previously defined, preferably $R_{10}$ and R' are hydrogen, and thioether carboxylic acids (TECA) of the structural formula:

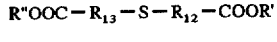

VIII where $R_{12}$ and $R_{13}$ are same or different and are $C_1$–$C_{12}$ alkyl and R' and R" are the same or different and are H or $C_1$–$C_8$ alkyl provided that at least one of R' and R" are hydrogen.

The preferred TECA are those wherein $R_{12}$ and $R_{13}$ are $C_1$–$C_4$ linear alkyl and R' and R" are both hydrogen.

The non-sulfur containing triazine antioxidant is used in an amount in the range 0.1 to 1.2 percent by weight, preferably 0.2 to 0.9 percent, most preferably 0.4 to 0.7 percent, while the SCCA derivative is used in an amount in the range 100 to 2000 ppm, preferably 200 to 1000 ppm, most preferably 400 to 1000 ppm.

The non-sulfur containing triazine antioxidant and a sulfur containing carboxylic acid and/or mixtures thereof are used in a ratio in the range of 2:1 to 50:1, preferably 3:1 to 20:1, most preferably 4:1 to 15:1.

The reduced-deposit oil, preferably synthetic polyol ester-based reduced-deposit oil may also contain one or more of the following classes of additives: antifoamants, antiwear agents, corrosion inhibitors, hydrolytic stabilizers, metal deactivator, detergents and additional antioxidants. Total amount of such other additives can be in the range 0.5 to 15 wt %, preferably 2 to 10 wt %, most preferably 3 to 8 wt %.

Antioxidants which can be used include aryl amines, e.g. phenylnaphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an amount in the range 0.5 to 4 wt %, preferably 1 to 3 wt %.

Corrosion inhibitors include but are not limited to various triazols e.g., tolyl triazole, 1,2,4 benzene triazol, 1,2,3 benzene triazol, carboxy benzotriazole, alkylated benzotriazole and organic diacids, e.g., sebacic acid.

The corrosion inhibitors can be used in an amount in the range 0.02 to 0.5 wt %, preferably 0.05% to 0.25 wt %.

As previously indicated, other additives can also be employed including hydrolytic stabilizers, pour point depressants, anti-foaming agents, viscosity and viscosity index improvers, etc.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pp. 1–11, the disclosures of which are incorporated herein by reference.

The additive combinations are useful in ester fluids including lubricating oils, particularly those ster fluids useful in high temperature avionic (turbine engine oils) applications. The additive combinations of the present invention exhibit excellent deposit inhibiting performance and improved oxidative stability as measured in the Inclined Panel Deposition Test.

The present invention is further described by reference to the following non-limiting examples.

EXAMPLE 1

This example illustrates the deposit formation performance for the most preferred embodiment of the invention by evaluating fully formulated oils in the Inclined Panel Deposit Test ("IPDT"). The additives tested were blended into a finished turbo oil formulation suitable for applications covered by the MIL-L-23699 specifications by using a constant package of additives and basestock. The basestock was a technical pentaerithritol ester made with an acid mixture of $C_5$ to $C_{10}$ commercially available acids. The additive package contained diaryl amine antioxidants, a commonly used metal passivator containing triaryl phosphates, a corrosion inhibitor consisting of alkylated benzotriazole, and a hydrolytic stabilizer. The total concentration of these other additives was 4.342 gms/100 gms polyol ester base stock.

The IPDT is a bench test consisting of a stainless steel panel electrically heated by means of two heater inserted into holes in the panel body. The test temperature is held at 299° C. The panel temperature is monitored using a recording thermocouple. The panel is inclined at a 4° angle and oil is dropped onto the heated panel near the top, allowing the oil to flow the length of the panel surface, drip from the end of the heated surface and be recycled to the oil reservoir. The oil forms a thin moving film which is in contact with air flowing through the test chamber. Test duration is 24 hours. Deposits formed on the panel are rated on a scale identical to that used for deposits formed in the bearing rig test (FED. Test Method STD. No. 791C, Method 3410.1). Varnish deposits rate from 0 (clean metal) to 5 (heavy varnish). Sludge deposits rate from 6 (light) to 8 (heavy). Carbon deposits rate from 9 (light carbon) to 11 (heavy/thick carbon). Higher ratings (12 to 20) are given to carbon deposits that crinkle or flake away from the metal surface during the test. The total weight of the deposit formed in 24 hours is also measured. In addition, the final viscosity, measured at 40° C., and Total Acid Number ("TAN"), expressed as mg KOH/100 ml, of the used oil are measured after the test is complete, and used as an evaluation of the oxidation of the oil.

Table 1 illustrates the deposition synergistic effect between a series of SCCA compounds and triazine compound III, "Triazine", where R1, R2, R3, and R4 are all dibutylamino and X is piperidino. The SCCAerivatives used were:

Compound A: Thiosalicylic acid (TSA); compound VII wherein $R_{10}$ is H and R' is H Compound B: 3,3' Thiodipropionic acid (TDPA) a TECA derivative; compound VIII wherein R' and R" are H and $R_{12}$ and $R_{13}$ are $C_3H_6$.

The concentration of the triazine in 0.6 gms/100 gms basestock in all cases.

TABLE 1

| SCCA Compound | Triazine | SCCA Concentration | Deposit Rating | Deposit Weight |
|---|---|---|---|---|
| None | None | N/A | 4.3 | 0.24 gms |
| None | 0.6% | None | 3.9 | 0.25 gms |
| A (TSA) | None | 0.10% | 4.4 | 0.22 gms |
| A (TSA) | 0.6% | 0.10% | 3.4 | 0.07 gms |
| B (TDPA) | None | 0.05% | 3.2 | 0.17 gms |
| B (TDPA) | 0.6% | 0.05% | 2.9 | 0.12 gms |

Table 1 shows that the addition of the triazine has little effect on the deposition performance. The addition of compound A without the triazine present does not improve the deposition rating or weight significantly. However, the addition of triazine to compound A results in a 23% reduction in deposit ratings with a 68% reduction in the deposit weight. The addition of compound B without the triazine present does improve both the deposit rating and weight. However, this reduction is enhanced by 9% in deposit rating and 29% in deposit weight by the addition of the triazine. This illustrates the strong interaction for SCCA compounds.

EXAMPLE 2

Measurement of the oxidative degredation of the oil tested in Example 1 were made by measuring the change in viscosity and acid number, TAN, versus the fresh oil.

Table 2 illustrates the oxidative synergisms for the same compounds in the same test by measuring the percent increase in viscosity and the increase in TAN. The decrease in deposit weight, illustrated in Table 1, might be expected to result in increased Viscosity increase or TAN increase. This is due to solubilization of incipient deposits by the oil resulting in a larger concentration of high molecular weight, partially oxidized molecules. However, Table 2 clearly illustrates that no such effect is observed. Viscosity and TAN changes are dramatically lower for these combinations indicating that not only are deposits reduced as shown in Example 1, but incipient deposits and other partially oxidized species are not formed in the same quantifies when both the triazine and SCCA compounds are present.

TABLE 2

| SCCA Compound | Triazine | SCCA Concentration | Viscosity Increase | TAN Increase, mg KOH/L |
|---|---|---|---|---|
| None | None | N/A | 101% | 14.2 |
| None | 0.6% | None | 94% | 10.5 |
| A (TSA) | None | 0.10% | 49.4% | 7.9 |
| A (TSA) | 0.6% | 0.10% | 19.5% | 2.3 |
| B (TDPA) | None | 0.05% | 27.1% | 2.2 |
| B (TDPA) | 0.6% | 0.05% | 16.5% | 1.5 |

Significant improvements in Viscosity and/or TAN increase are observed for combinations of compounds A or B with triazine over any formulation without both compounds present. For compound A, the combination reduces the Viscosity increase by 61% and the TAN increase by 71%, as compared to A alone; for compound B, the combination reduces the Viscosity increase by 39%, and the TAN increase by 32%, as compared to B alone.

What is claimed is:

1. A turbo oil composition exhibiting enhanced resistance to deposition and improved oxidative stability, said turbo oil formulation comprising a major portion of a synthetic polyol ester based base stock and a minor portion of an additive comprising non-sulfur containing substituted triazine derivative of the formula:

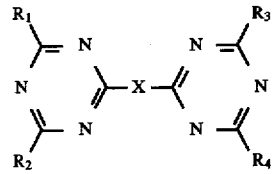

III or

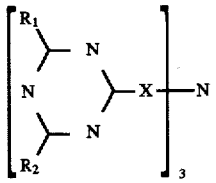

IIIa where $R_1$, $R_2$ $R_3$, $R_4$ are the same or different and are

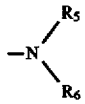

wherein $R_5$ and $R_6$ are the same or different and are selected from the group consisting of $C_2$ to $C_{16}$ branched or straight chain alkyl, aryl-$R_7$ where $R_7$ is branched or straight chain $C_2$ to $C_{16}$ alkyl, or cyclohexyl-$R_7$ where $R_7$ is H or branched or straight chain $C_2$ to $C_{16}$ alkyl and mixtures thereof, and wherein in formula III X is a bridging group selected from the group consisting of piperidino, hydroquinone, NH—$R_8$—NH where $R_8$ is $C_1$ to $C_{12}$ branched or straight chain alkyl and mixtures thereof, and in formula IIIa X is selected from the group consisting of piperidino, hydroquinone, NH—$R_8$ where $R_8$ is $C_1$ to $C_{12}$ branched or straight chain alkyl and mixtures thereof, and in formula IIIa X is selected from the group consisting of piperidino hydroquinone, NH $R_8$ where $R_8$ is $C_1$ to $C_{12}$ branched or straight chain alkyl and mixtures thereof and a sulfur containing carboxylic acid (SCCA), wherein the sulfur containing carboxylic acid is represented by the structural formula:

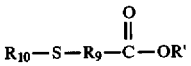

wherein $R_9$ is $C_1$–$C_{12}$ alkylene, arylene, $C_1$ to $C_8$ alkyl substituted arylene and mixtures thereof, R' is hydrogen, $R_{10}$ is hydrogen, $C_1$–$C_{12}$ alkyl, aryl, $C_1$ to $C_8$ alkyl substituted aryl; or the structural formula:

$$R''OOC—R_{11}—S—R_9—COOR'$$

wherein $R_9$ and $R_{11}$ are the same or different and are $C_1$–$C_{12}$ alkylene, arylene, $C_1$ to $C_8$ alkyl substituted arylene and mixtures thereof, and R' and R" are the same or different and are hydrogen, or $C_1$–$C_8$ alkyl provided that at least one of R' and R" is hydrogen.

2. The turbo oil composition of claim 1 wherein non-sulfur containing triazine antioxidant is added in an amount in the range 0.1 to 1.2 percent by weight, while SCCA is used in an amount in the range 100 to 2000 ppm.

3. The turbo oil composition of claim 1 wherein the synthetic polyol ester based base stock is the esterification product of an aliphatic polyol containing 4 to 15 carbon atoms and from 2 to 8 esterifiable hydroxyl groups reacted with a carboxylic acid containing from 4 to 12 carbon atoms.

4. The turbo oil composition of claim 3 wherein the synthetic ester based base stock is the esterification product of technical pentaerythritol and a mixture of $C_4$ to $C_{12}$ carboxylic acids.

5. The turbo oil composition of claim 1 wherein the non-sulfur containing triazine antioxidant and sulfur containing carboxylic acid are used in a ratio in the range of 2:1 to 50:1.

6. The turbo oil composition of claims 1, 2, 3, 4 or 5 where the substituted triazine is of the formula:

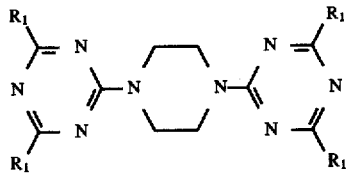

where R1 is dibutylamino.

7. The turbo oil composition of claim 1, 2, 3, 4, or 5 wherein the sulfur containing carboxylic acid is represented by the structural formula $$R''OOC—R_{13}—S—R_{12}—COOR'$$

wherein $R_{12}$ and $R_{13}$ are same or different and are $C_1$–$C_{12}$ alkylene and R' and R" are the same or different and are H or $C_1$–$C_8$ alkyl provided that at least one of R' and R" is hydrogen.

8. The turbo oil of claim 7 wherein R' and R" are both H and $R_{12}$ and $R_{13}$ are linear $C_1$–$C_4$ alkyl.

9. The turbo oil composition of claim 1, 2, 3, 4, or 5 wherein the sulfur containing carboxylic acid is represented by the structural formula:

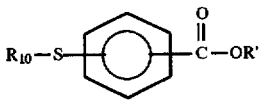

wherein R' is hydrogen, $R_{10}$ is hydrogen, $C_1$–$C_{12}$ alkyl, aryl, $C_1$–$C_8$ alkyl substituted aryl;

or the structural formula:

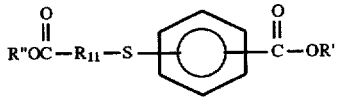

wherein $R_{11}$ is $C_1$–$C_{12}$ alkyl, aryl, $C_1$–$C_8$ alkylene, arylene, $C_1$ to $C_8$ substituted aryl and mixtures thereof and R' and R" are the same or different and are hydrogen, $C_1$–$C_8$ alkyl provided that at least one of R' and R" is hydrogen.

10. The turbo oil composition of claim 9 wherein R' and R" are both hydrogen.

11. The turbo oil composition of claim 6 wherein when the sulfur containing carboxylic acid is represented by the structural formula $$R''OOC—R_{13}—S—R_{12}—COOR'$$

$R_{12}$ and $R_{13}$ are same are $C_1$–$C_{12}$ alkylene and R' and R" are the same or different and are H or $C_1$–$C_8$ alkyl provided that at least one of R' and R" is hydrogen.

12. The turbo oil of claim 11 wherein R' and R" are both H and $R_{12}$ and $R_{13}$ are linear $C_1$–$C_4$ alkyl.

13. The turbo oil composition of claim 6 wherein the sulfur containing carboxylic acid is represented by the structural formula:

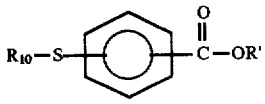

wherein R' is hydrogen, $R_{10}$ is hydrogen, $C_1$–$C_{12}$ alkyl, aryl, $C_1$–$C_8$ alkyl substituted aryl; or the structural formula:

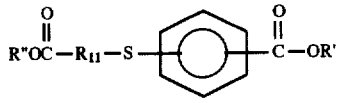

wherein $R_{11}$ is $C_1$–$C_{12}$ alkylene, arylene, $C_1$–$C_8$ alkyl substituted arylene and mixtures thereof and R' and R" are the same or different and are hydrogen, $C_1$–$C_8$ alkyl provided that at least one of R' and R" is hydrogen.

14. The turbo oil composition of claim 13 wherein R' and R" are both hydrogen.

15. The turbo oil of claim 6 wherein the sulfur containing carboxylic acid is selected from the group consisting of:

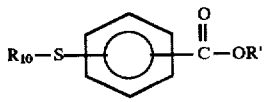

wherein $R_{10}$ is H and $R_1$ is H; and $$R''COO—R_{13}—S—R_{12}—COOR'$$

wherein R' and R" are H and $R_{12}$ and $R_{13}$ are $C_3H_6$.

* * * * *